US011006803B2

(12) United States Patent
Blum

(10) Patent No.: US 11,006,803 B2
(45) Date of Patent: May 18, 2021

(54) SWEEPING BRUSH FOR AN AUTOMATICALLY MOVING CLEANING DEVICE

(71) Applicant: Vorwerk & Co. Interholding GmbH, Wuppertal (DE)

(72) Inventor: Michael Blum, Wuppertal (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 262 days.

(21) Appl. No.: 16/106,630

(22) Filed: Aug. 21, 2018

(65) Prior Publication Data

US 2019/0059676 A1 Feb. 28, 2019

(30) Foreign Application Priority Data

Aug. 22, 2017 (DE) ..... 10 2017 119 216.6

(51) Int. Cl.

| | |
|---|---|
| ***A47L 11/19*** | (2006.01) |
| ***A47L 9/04*** | (2006.01) |
| ***A47L 11/24*** | (2006.01) |
| ***A47L 11/40*** | (2006.01) |
| ***A46B 13/00*** | (2006.01) |

(Continued)

(52) U.S. Cl.

CPC ..... *A47L 11/19* (2013.01); *A46B 5/0012* (2013.01); *A46B 5/0066* (2013.01); *A46B 7/06* (2013.01); *A46B 7/08* (2013.01); *A46B 7/10* (2013.01); *A46B 13/001* (2013.01); *A46B 13/008* (2013.01); *A46B 15/0053* (2013.01); *A47L 9/0411* (2013.01); *A47L 9/0466* (2013.01); *A47L 9/0472* (2013.01);

(Continued)

(58) Field of Classification Search

CPC . A46B 13/001; A46B 13/008; A46B 15/0053; A46B 2200/3033; A46B 5/0012; A46B 5/0066; A46B 7/06; A46B 7/08; A46B 7/10; A47L 11/19; A47L 11/24; A47L 11/4041; A47L 11/4061; A47L 2201/00; A47L 9/0411; A47L 9/0466; A47L 9/0472; A47L 9/0477; A47L 9/0488

See application file for complete search history.

(56) References Cited

U.S. PATENT DOCUMENTS

2013/0056026 A1* 3/2013 Jung ..... A47L 9/0411 134/6
2013/0086760 A1* 4/2013 Han ..... A47L 11/4058 15/49.1

(Continued)

FOREIGN PATENT DOCUMENTS

DE 10 2010 037 672 A1 3/2012
DE 102010037672 A1 * 3/2012 ..... A47L 11/4038

(Continued)

*Primary Examiner* — Marc Carlson
(74) *Attorney, Agent, or Firm* — Collard & Roe, P.C.

(57) ABSTRACT

A sweeping brush for an automatically moving cleaning device has a rotational axis receptacle for receiving a rotational axis of the cleaning device and at least one bundle receptacle that extends outwardly from a transition area on the rotational axis receptacle, which holds a bristle bundle having a plurality of bristles. The bundle receptacle is arched as viewed in an axial direction of the rotational axis receptacle. In order to optimize known sweeping brushes in terms of their service life and cleaning properties, the bundle receptacle is fabricated out of an elastic material.

7 Claims, 6 Drawing Sheets

(51) Int. Cl.

| | |
|---|---|
| ***A46B 5/00*** | (2006.01) |
| ***A46B 7/10*** | (2006.01) |
| ***A46B 15/00*** | (2006.01) |
| ***A46B 7/06*** | (2006.01) |
| ***A46B 7/08*** | (2006.01) |

(52) U.S. Cl.

CPC ..... *A47L 9/0477* (2013.01); *A47L 9/0488* (2013.01); *A47L 11/24* (2013.01); *A47L 11/4041* (2013.01); *A47L 11/4061* (2013.01); *A46B 2200/3033* (2013.01); *A47L 2201/00* (2013.01)

(56) References Cited

U.S. PATENT DOCUMENTS

| | | | | |
|---|---|---|---|---|
| 2013/0160226 | A1* | 6/2013 | Lee | A47L 9/0488 15/21.1 |
| 2014/0067116 | A1* | 3/2014 | Moon | A47L 9/2873 700/245 |
| 2016/0166127 | A1* | 6/2016 | Lewis | A47L 9/0477 15/49.1 |
| 2018/0317724 | A1* | 11/2018 | Cheung | A47L 9/0477 |
| 2018/0338655 | A1* | 11/2018 | Schregardus | A47L 9/0477 |
| 2020/0060487 | A1* | 2/2020 | Thomas | A47L 9/0466 |

FOREIGN PATENT DOCUMENTS

| | | | |
|---|---|---|---|
| JP | 2015-091290 | A | 5/2015 |
| WO | 2013/051843 | A1 | 4/2013 |
| WO | 2014/035152 | A1 | 3/2014 |
| WO | 2016/093910 | A1 | 6/2016 |

* cited by examiner

SWEEPING BRUSH FOR AN AUTOMATICALLY MOVING CLEANING DEVICE

CROSS REFERENCE TO RELATED APPLICATIONS

Applicant claims priority under 35 U.S.C. § 119 of German Application No. 10 2017 119 216.6 filed on Aug. 22, 2017, the disclosure of which is incorporated by reference.

BACKGROUND OF THE INVENTION

1. Field of the Invention

The invention relates to a sweeping brush for an automatically moving cleaning device, wherein the sweeping brush has a rotational axis receptacle for receiving a rotational axis of the cleaning device and at least one bundle receptacle that extends outwardly from a transition area on the rotational axis receptacle, which holds a bristle bundle having a plurality of bristles, wherein the bundle receptacle is arched as viewed in an axial direction of the rotational axis receptacle.

In addition, the invention relates to a sweeping brush for an automatically moving cleaning device, wherein the sweeping brush has a rotational axis receptacle for receiving a rotational axis of the cleaning device and at least one bristle bundle that extends outwardly from a transition area on the rotational axis receptacle and has a plurality of bristles, wherein the transition area has a bundle bearing on which the bristle bundle is articulated relative to a circumferential direction, so that the bristle bundle can be swiveled around a bearing midpoint of the bundle bearing during a rotation of the sweeping brush.

Furthermore, the invention relates to an automatically moving cleaning device with a sweeping brush that can rotate around a rotational axis, which has a rotational axis receptacle for receiving a rotational axis of the cleaning device and at least one bundle receptacle that extends outwardly from a transition area on the rotational axis receptacle, in which a bristle bundle having a plurality of bristles is held, wherein the bundle receptacle is arched opposite a rotational direction of the rotational axis as viewed in an axial direction of the rotational axis receptacle.

In addition, the invention relates to an automatically moving cleaning device with a sweeping brush that can rotate around a rotational axis, which has a rotational axis receptacle for receiving a rotational axis of the cleaning device and a bristle bundle that extends outwardly from a transition area on the rotational axis receptacle and has a plurality of bristles, wherein the transition area has a bundle bearing on which the bristle bundle is articulated relative to a circumferential direction, so that the bristle bundle can be swiveled around a bearing midpoint of the bundle bearing opposite a rotational direction of the rotational axis during a rotation of the sweeping brush.

2. Description of the Related Art

Sweeping brushes and automatically moving cleaning devices with such a sweeping brush are known in prior art, for example from US 2013/0086760 A1 and US2013/0160226 A1. For example, the cleaning devices are designed as autonomously operating vacuuming and/or sweeping devices, which are used in particular in a household. Known in this regard, if necessary in addition to vacuuming the floor to be cleaned, is to brush the latter, for which purpose a cleaning roller that can rotate around a horizontal axis is further preferably provided. In order to achieve a further improved edge cleaning, for example on baseboards or the like, the floor cleaning devices are also equipped with a sweeping brush, which has an essentially vertically oriented rotational axis.

For example, publication DE 10 2010 037 672 A1 discloses a cleaning device with a sweeping brush, which has a plurality of bristle bundles that are accommodated in a respective rigid receptacle that is directed and elongated radially outward.

Due to the permanent contact between the bristle bundle and a surface to be cleaned and the rotation of the sweeping brush relative to the surface, the bristle bundles are subject to a high level of wear, which can result in deformation, and thus less successful cleaning.

SUMMARY OF THE INVENTION

Proceeding from the aforementioned prior art, the object of the invention is thus to create a sweeping brush for a cleaning device, which has been improved as relates to less wear and an optimal cleaning performance.

Initially proposed for achieving this object is a sweeping brush whose bundle receptacle is fabricated out of an elastic material.

The bundle receptacle can be fabricated out of a flexible plastic, in particular a rubbery plastic like EPDM (ethylene-propylene-diene rubber). The elastic material of the bundle receptacle allows a further deformation of the bundle receptacle under a load while using the sweeping brush. However, since the bundle receptacle is already pre-bent, deformation owing to the load is relatively slight. Apart from the type of material, the flexibility of the bundle receptacle can also be influenced by the shape of the profile and material thickness. The degree of hardness of the elastic material further determines the extent to which the bundle receptacles of the sweeping brush can give way when hitting an obstacle, so as not to be damaged.

The bundle receptacle is arched, so that the bristles of the bristle bundle protruding from the bundle receptacle assume an altered angle relative to the surface to be cleaned. This prevents individual bristles from standing straight up inside of the bristle bundle, so that the bristle bundle deforms to less of an extent, thereby yielding an improved cleaning effect. The sweeping brush can be connected with the cleaning device in such a way that the bundle receptacle is bent opposite a rotational direction of the sweeping brush, so that the bundle receptacle runs ahead while the sweeping brush rotates, and the bristle bundle follows the movement, specifically in such a way as to draw the bristles protruding from the bundle receptacle over the surface to be cleaned with the free end areas of the bristles. This prevents the bristles from combing "against the grain", which would cause the bristle bundles to deform.

The bundle receptacles can have different cross sectional shapes. The cross sectional shape is preferably round or elliptical. Given an unsymmetrical, for example elliptical, shape, the respective side with the larger side length is preferably transverse to the rotational direction of the sweeping brush. The sweeping brush can basically have just one bristle bundle. However, a configuration of the sweeping brush with a plurality of bristle bundles is especially preferred. Particularly suitable is a number of three to seven bristle bundles, whose bundle receptacles especially preferably are arranged on the rotational axis receptacle at identical angular distances. As a result, identically sized angular ranges are included between the bundle receptacles adjoining each other in the circumferential direction of the rotational axis receptacle. However, it is basically also possible to provide varying distances between the adjoining bundle receptacles.

It is proposed that an end area of the bundle receptacle facing away from the rotational axis receptacle be displaced by an angle of approx. 20° to 80°, in particular by an angle of 30° to 60°, relative to a radial direction that intersects the rotational axis and transitional area. Proceeding from an assumed straight configuration of the bundle receptacle in a radial direction relative to the rotational axis, the bundle receptacle is now bent in such a way that the end area of the bundle receptacle where the bristles exit is displaced by an angle of 20° to 80°, in particular by an angle of 30° to 60°. The indicated angles each relate to a rotational axis accommodated in the rotational axis receptacle. An especially preferred embodiment proposes a bend where the end area of the bundle receptacle is displaced by an angle of 45° around the rotational axis, so that the bundle receptacle bends correspondingly proceeding from the transition area on the rotational axis receptacle. The measure of the bend here also depends not least on the material of the bundle receptacle. The arched shape of the bundle receptacle is preferably designed in such a way as to yield a nearly constant bending radius. In particular, the arched shape contains no unsteady areas in which the bundle receptacle is kinked.

An alternative embodiment proposes a sweeping brush for an automatically moving cleaning device, which has a rotational axis receptacle for receiving a rotational axis of the cleaning device and at least one bundle receptacle having a plurality of bristles, which extends outwardly from a transition area on the rotational axis receptacle, wherein the transition area has a bundle bearing on which the bristle bundle is articulated relative to a circumferential direction, so that the bristle bundle can be swiveled around a bearing midpoint of the bundle bearing during a rotation of the sweeping brush, and wherein the bundle receptacle is fabricated out of an elastic material. In this embodiment, the bristle bundles are pivotably arranged in the transition area, so that the bristle bundles can be swiveled relative to the rotational axis receptacle when the sweeping brush rotates around the rotational axis of the cleaning device. Depending on the current rotational position of the sweeping brush in the rotational direction, the bristle bundle thus follows the movement of the rotational axis receptacle. This configuration also prevents the bristles of the bristle bundle from standing transverse to a rotational direction of the sweeping brush, which would result in individual fibers standing straight up, and thus also in an increased wear on the bristle bundles. In an especially simple configuration, for example, the bundle bearing arranged on the transition area of the rotational axis receptacle can be a recess or through hole, into which engages a projection or pin formed on the bundle receptacle. For example, the pin can also be designed as a rivet, whose outer diameter is tailored to an inner diameter of the bundle bearing in such a way as to allow the through hole to pivot with a low friction.

This embodiment can also provide that the bristle bundle be held by means of a bundle receptacle on the rotational axis receptacle. The bristles are here partially enveloped by a stabilizing bundle receptacle, which is in turn connected with the bundle bearing.

In both generally possible embodiments of sweeping brushes, specifically those with an arched bundle receptacle on the one hand and those with a bristle bundle pivotably mounted to a bundle bearing on the other, it can preferably be provided that the bristle bundle be overmolded with the material of a bundle receptacle. To this end, the bristle bundle is overmolded with a plastic polymer in an injection molding process. Alternatively, the bundle receptacle can also be shrunk onto the bristle bundle, for which purpose a plastic hose is guided over the bristle bundle and there heated.

It is basically unnecessary to anchor the bristles of the bristle bundle in the rotational axis receptacle and pull through the bundle receptacle completely. It can rather be provided that the bundle receptacle function as an intermediate piece between the rotational axis receptacle and bristle bundles, wherein only the end areas of the bristles are preferably anchored in the bundle receptacle, but not guided over the entire length of the bundle receptacle up until the rotational axis receptacle. In this configuration, the bundle receptacle essentially serves as a cantilever arm of the rotational axis receptacle, which reduces the distance between the rotational axis receptacle and the surface to be cleaned.

In addition, it is proposed that the length of the bundle receptacle be roughly one to three times as large as the length of the bristle bundle protruding from the bundle receptacle. For example, the entire length comprising the bundle receptacle and the protruding length of the bristle bundle can have a length of about 30 mm to 80 mm, wherein a part of this length consists of the bundle receptacle, and the other part consists of the visible partial area of the bristle bundle. Especially suitable here is a ratio between the bundle receptacle and exposed partial area of the bristle bundle of 2:1. As a consequence, the largest part of the length is comprised of the bundle receptacle, which performs a guiding and stabilizing task for the bristles located therein, but is not intended to act on the surface to be cleaned. In this regard, it is recommended that the largest possible portion of the length be bridged by the bundle receptacle. In particular, this makes it possible to also reduce wear on the sweeping brush, since the bundle receptacle is subject to less wear by comparison to the bristles. In relation to a cross section, the individual bristles can be round plastic fibers with a diameter of 0.1 mm to 0.3 mm, further preferably of up to 0.2 mm. These bristles are combined into the bristle bundle, for example which is bundled over a length of 20 mm to 40 mm. This bundling takes place proceeding from the rotational axis receptacle in the direction toward the bristle ends. For example, there remains a free length of the bristles or bristle bundle outwardly protruding from the bundle receptacle of likewise 10 mm to 40 mm. For example, a bristle bundle can have 150 to 250 bristles, further preferably about 200 bristles.

An embodiment proposes that the sweeping brush have several bundle receptacles, which exhibit material properties and/or cross sectional shapes and/or bending radii that differ from each other. For example, the sweeping brush can thus have bundle receptacles with varying degrees of hardness, varying profile cross sections or varyingly shaped bends. In particular, it can be provided that the bundle receptacles be bent to varying degrees, have different lengths, hold bristles of varying length and/or have different cross sectional shapes, in particular round or elliptical. In particular, the varying configurations can lead to an irregularity in the rotational movement of the sweeping brush on different underlying surfaces, so that a better overall cleaning result can be achieved. In particular, the configuration of the bundle receptacles of the sweeping brush makes it possible to trigger an oscillation of the sweeping brush.

In addition, it is proposed that the bundle receptacle extend at an inclination to a plane having the rotational axis receptacle as viewed in a direction oriented perpendicular to the rotational axis, in particular at an angle of approx. 5° to 20°. As a result of this embodiment, the bundle receptacles along with the bristle bundles connected thereto protrude in the direction of the surface to be cleaned when the sweeping brush is fastened to the rotational axis of the cleaning device. The bundle receptacles thus do not extend only into a single plane, but are also formed in a direction parallel to the rotational axis. As a consequence, the free ends of the bristles are simultaneously also inclined relative to the surface to be cleaned, so that as many of the bristles as possible can come into contact with the surface to be cleaned. The bristles of a bristle bundle can preferably also have varying lengths for this purpose.

Apart from the embodiments of sweeping brushes proposed above, the invention further also proposes an automatically moving cleaning device with a sweeping brush that can rotate around a rotational axis having a rotational axis receptacle for receiving a rotational axis of the cleaning device and at least one bundle receptacle that extends outwardly proceeding from a transition area on the rotational axis receptacle, which holds a bristle bundle having a plurality of bristles, wherein the bundle receptacle is arched opposite a rotational direction of the rotational axis as viewed in an axial direction of the rotational axis receptacle, and wherein the bundle receptacle is fabricated out of an elastic material.

In addition, the automatically moving cleaning device can alternatively also have a sweeping brush with a rotational axis receptacle for receiving a rotational axis of the cleaning device and a bristle bundle that extends outwardly proceeding from a transition area on the rotational axis receptacle and has a bristle bundle exhibiting a plurality of bristles, wherein the transition area has a bundle bearing on which the bristle bundle is articulated relative to a circumferential direction, so that the bristle bundle can be swiveled around a bearing midpoint of the bundle bearing opposite a rotational direction of the rotational axis during a rotation of the sweeping brush, and wherein the bundle receptacle is fabricated out of an elastic material.

The rotational axis of the cleaning device has allocated to it an electric motor, which can rotate around the rotational axis, and hence the sweeping brush connected therewith, at a speed of 100 RPM to 200 RPM, for example. In a preferred embodiment, for example, the radially outer bristle ends of the bristle bundle rotate at speeds of 0.9 m/s to 1.5 m/s, depending on the distance from the rotational axis.

The additional advantages and features of the proposed cleaning device are derived as described previously with regard to the sweeping brush according to the invention.

All indicated value ranges also include intermediate values not explicitly mentioned, in particular in 1-degree increments and/or 1-millimeter increments, in particular as relates to a single or multiple restriction of the indicated range limits in the indicated increment.

BRIEF DESCRIPTION OF THE DRAWINGS

The invention will be described in more detail below based on exemplary embodiments. In the drawings.

DETAILED DESCRIPTION OF THE PREFERRED EMBODIMENTS

Figure 1:
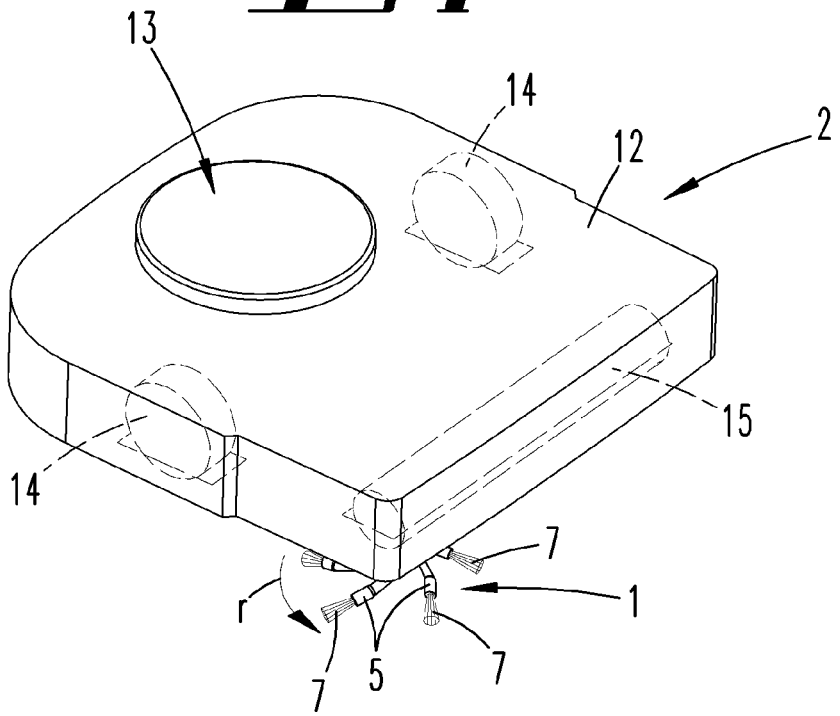
FIG. 1 is a perspective view of a cleaning device according to the invention.
Figure 2:
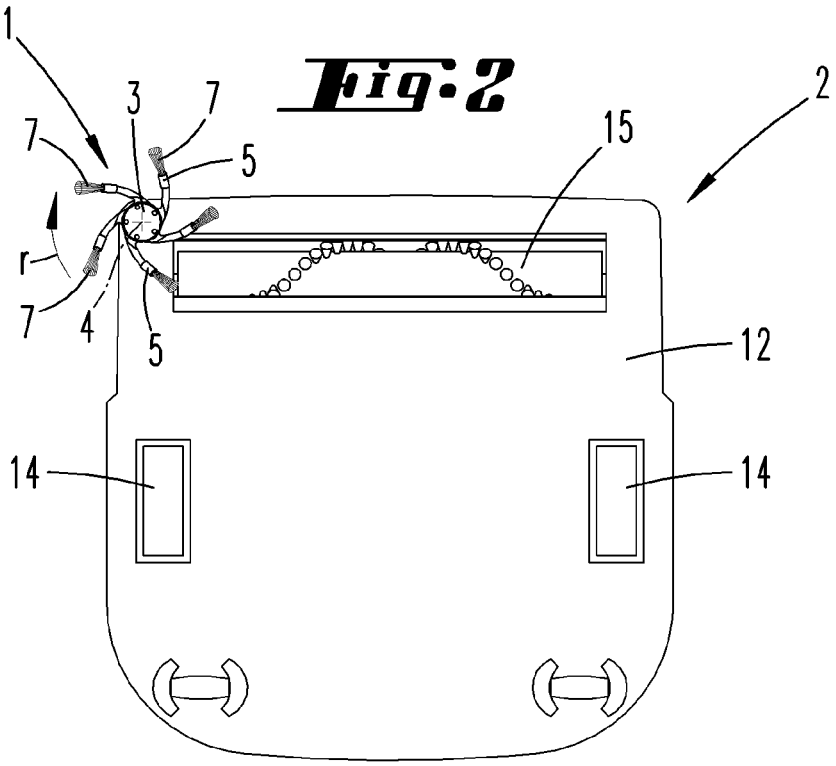
FIG. 2 is a bottom view of the cleaning device.

FIGS. 1 and 2 show an automatically traversable cleaning device 2 in the form of a sweeping device, with a housing 12, two electric motor-driven wheels 14, a cleaning roller 15 rotatable around a horizontal axis and a sweeping brush 1 rotating around an essentially vertical rotational axis 4.

The cleaning device 2 has a navigation device, by means of which the cleaning device 2 can orient itself and move autonomously within the environment. The navigation device incorporates a distance measuring device 13 arranged inside of the housing 12, which measures distances from obstacles within the environment of the cleaning device 2. For example, the distance measuring device 13 can be an optical triangulation measuring device, which has a laser source and a sensor. The laser source emits light in the environment of the cleaning device 2, while the sensor detects light reflected back from obstacles. The distance from obstacles can be determined therefrom, and also further processed into an area map, which the navigation device accesses for a movement of the cleaning device 2.

During a movement, the cleaning device 2 cleans a surface to be cleaned by means of the cleaning roller 15 and sweeping brush 1. The cleaning roller 15 along with the sweeping brush 1 are driven by electric motors, which are supplied with energy by a battery arranged in the cleaning device 2. The sweeping brush 1 protrudes partially over the contour of the housing 12, for example so as to be able to clean more intensively on spatial boundaries like baseboards. The dirt picked up by the cleaning roller 15 and sweeping brush 1 is conveyed by a suction air stream of a motor-fan unit of the cleaning device 2 (not shown) into a dust collector (not shown).

Figure 3:
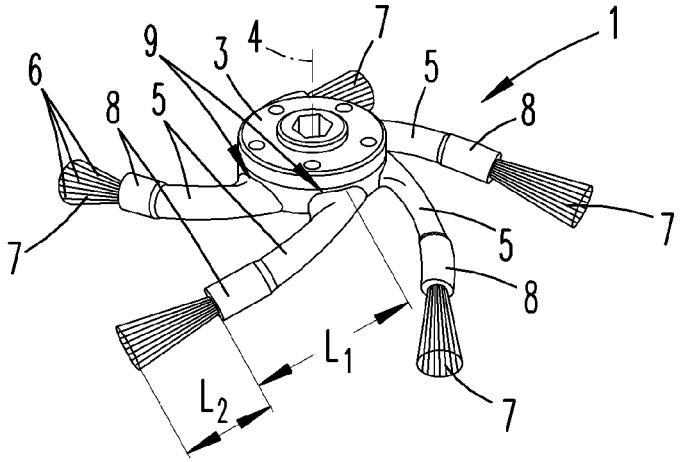
FIG. 3 is a perspective view of the sweeping brush according to the invention.
Figure 4:
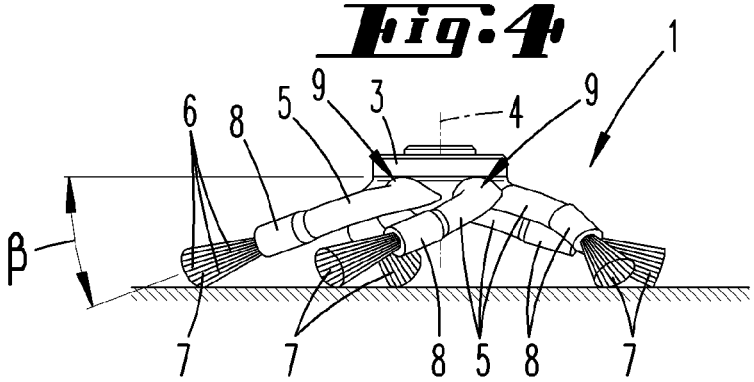
FIG. 4 is a side view of the sweeping brush.
Figure 5:
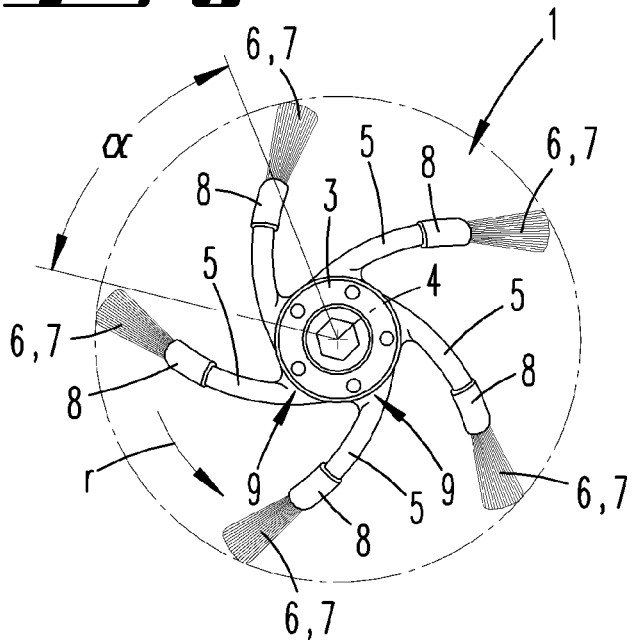
FIG. 5 is a top view of the sweeping brush

FIGS. 3 to 5 show the sweeping brush 1 of the cleaning device 2 from different perspectives. The sweeping brush 1 has a rotational axis receptacle 3 that can be connected with the rotational axis 4 of the cleaning device 2. The rotational axis receptacle 3 is a hub which here has an essentially circular layout. A total of five bundle receptacles 5 are here formed on the rotational axis receptacle 3, for example which are splashed onto the rotational axis receptacle 3 in a transition area 9 of the latter. The bundle receptacles 5 are arched. In an end area 8 of the bundle receptacle 5, a bristle bundle 7 with a plurality of bristles 6 is guided out of the bundle receptacle 5. The bristles 6 can either intersect the entire length of the bundle receptacle 5 up to the transition area 9 and be anchored in the rotational axis receptacle 3, or alternatively not be formed over the entire length of the bundle receptacle 5, but for example already be anchored in the end area 8 of the bundle receptacle 5. In particular, the bristles 6 of the bundle receptacle 7 can be overmolded with the material of the bundle receptacle 5.

The bundle receptacle 5 here has a rubbery material, for example EPDM. For example, a bristle bundle 7 here consists of 200 bristles 6, which are fabricated out of a thermoplastic resin, e.g., polybutylene terephthalate here. For example, the sum of the length $L_1$ of the bristle receptacle 5 and the length $L_2$ of the partial area of the bristle bundle 7 protruding from the bundle receptacle 5 here measures roughly 40 mm, wherein the bundle receptacle 5 is 25 mm long, and the protruding partial area of the bristle bundle 7 is roughly 15 mm long. As depicted on FIG. 4, the bundle receptacles 5, and hence also the bristle bundles 7, are inclined proceeding from a plane of the rotational axis receptacle 3 in the direction of a surface to be cleaned, wherein the bundle receptacle 5 here has an angle β of roughly 20° relative to the plane which has the rotational axis receptacle 3. In relation to the top view of the sweeping brush 1 shown on FIG. 5, the bundle receptacle 5 has an angle α of roughly 55° relative to a radial direction proceeding from the rotational axis 4. The angle α here denotes an angle between a straight line that proceeds from the rotational axis 4 through the middle of the transition area 9 of the bundle receptacle 5, and a straight line that proceeds from the rotational axis 4 through a middle of the end area 8 of the bundle receptacle 5.

Figure 6:
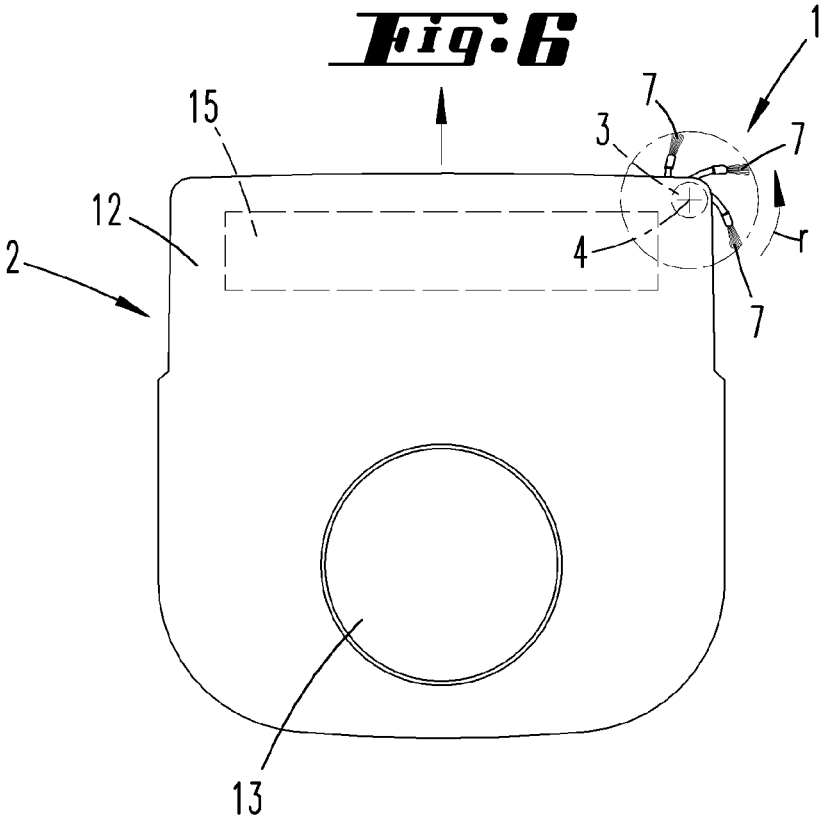
FIG. 6 is a top view of the cleaning device according to FIG. 1.
Figure 7:
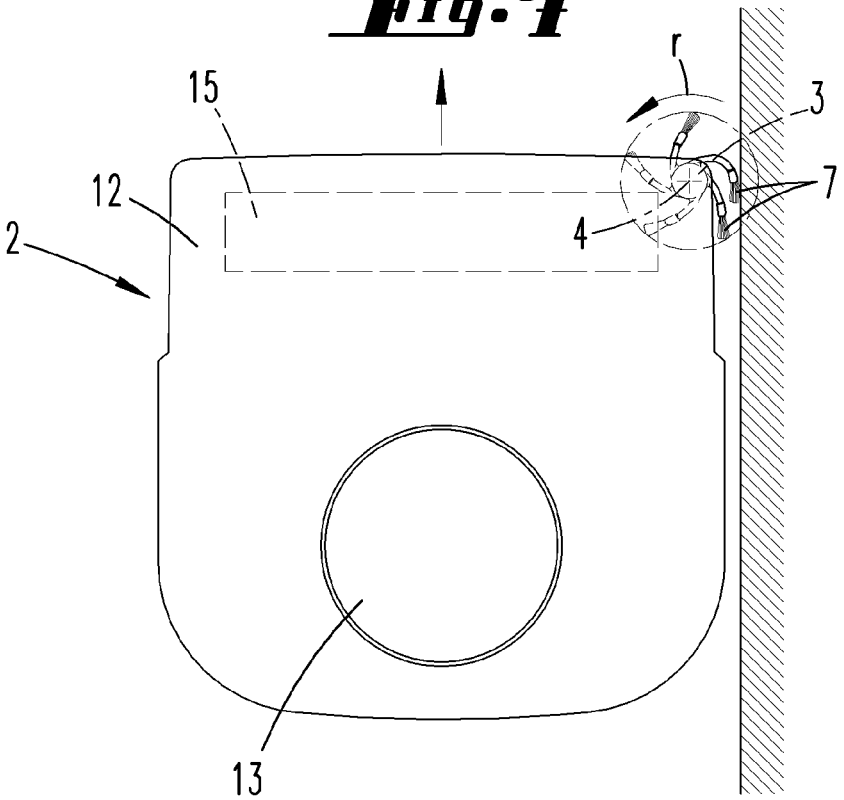
FIG. 7 is the cleaning device while cleaning a wall.
Figure 8:
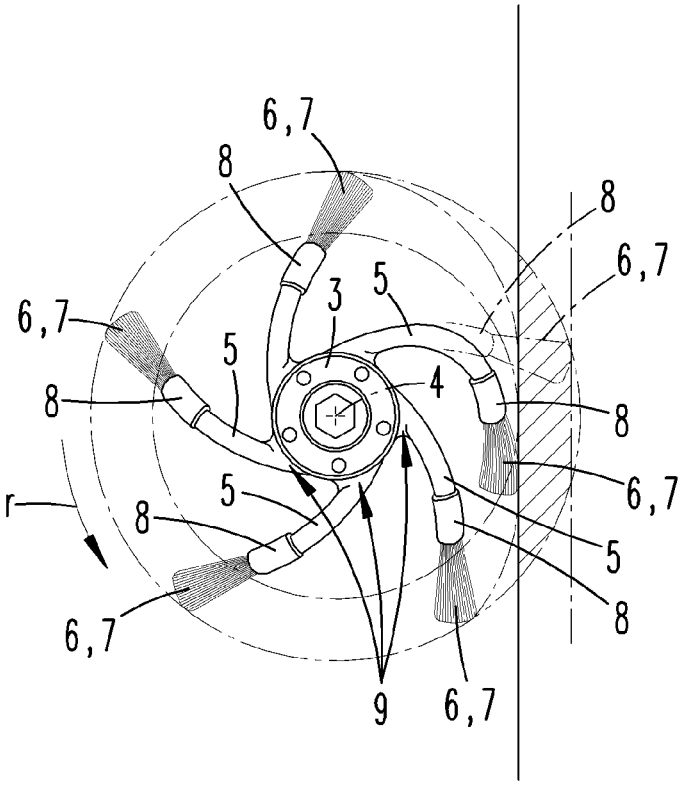
FIG. 8 is a magnified partial section from FIG. 7.

FIG. 6 to 8 show the sweeping brush 1 arranged on the cleaning device 2. The sweeping brush 1 rotates around the rotational axis 4 in a rotational direction r. The bundle receptacles 5 are bent against the rotational direction r, so that the bristle bundles 7 each point toward the back relative to the rotational direction 5, while the bundle receptacles 5 move ahead in the rotational direction r. As a result the bristles 6 of the bristle bundle 7 stay together and do not stand straight up, for example which would be the case when combing against the grain. In addition, the bent shape of the bundle receptacles 5 leads to only a minimal further deformation while processing the surface, which can be absorbed by the elasticity of the material of the bundle receptacle 5. If the sweeping brush 1 laterally hits an obstacle as shown on FIG. 7, for example a wall or baseboard, the elastic material of the bundle receptacles 5 further allows the bundle receptacles 5 to bend with a lower bending radius by comparison to the unloaded state depicted on FIG. 6.

FIG. 8 presents a magnified view of the sweeping brush 1 on FIG. 7. The deformation of the bristle bundle 7 is there shown while in contact with the obstacle.

Figure 9:
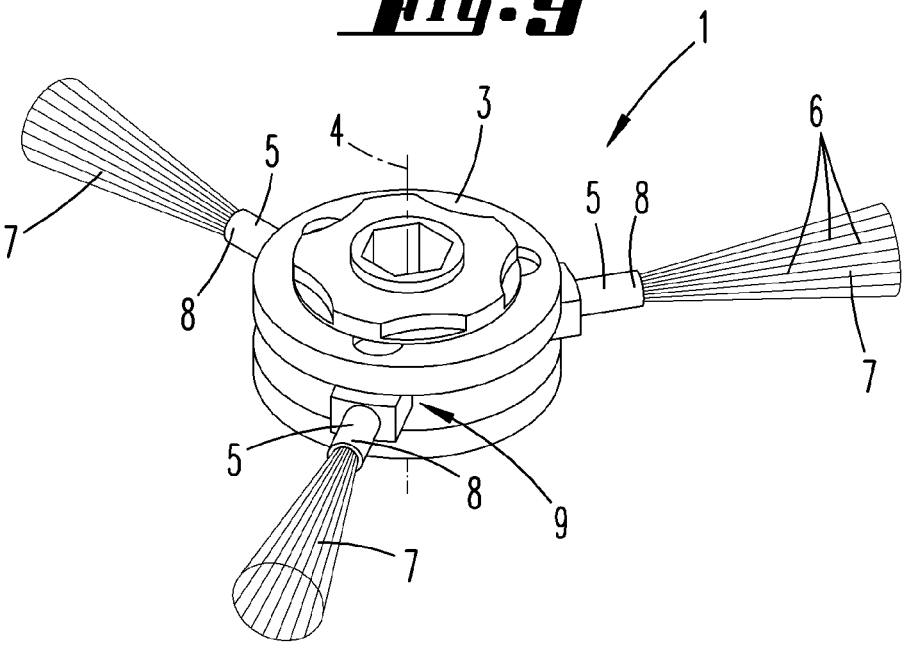
FIG. 9 is a perspective view of the sweeping brush according to a second embodiment.
Figure 10:
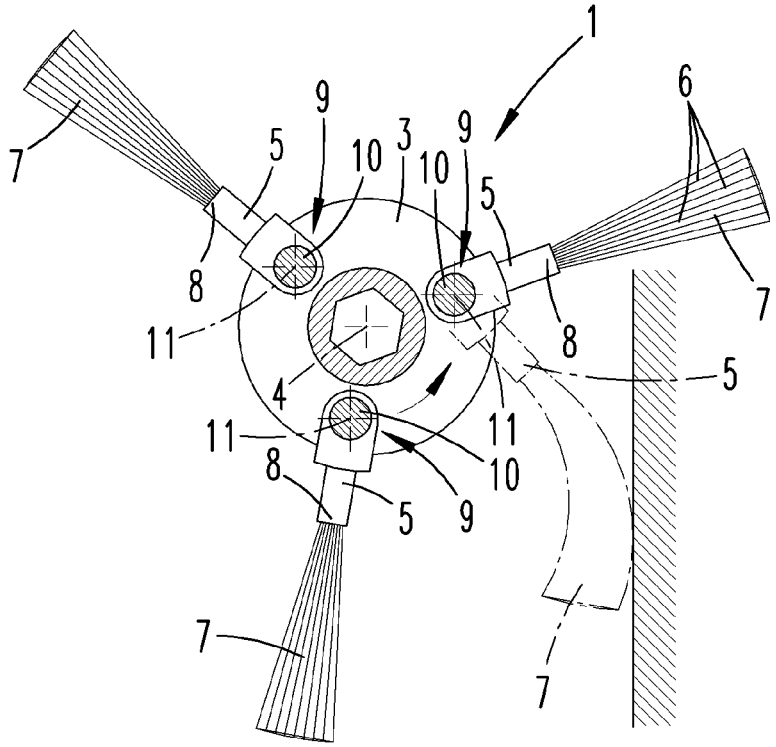
FIG. 10 is a top view of the sweeping brush shown on FIG. 9.

FIGS. 9 and 10 show another embodiment of a sweeping brush according to the invention, which also is designed for only minimal wear. To this end, the sweeping brush 1 has bundle receptacles 5 articulated to a rotational axis receptacle 3. The bundle receptacles 5 are each articulated to a bundle bearing 10 of the rotational axis receptacle 3, so that the bundle receptacle 5 including the bristle bundle 7 can be swiveled around a bearing midpoint 11 of the bundle bearing 10. The bristle bundles 7 can be overmolded with the material of the bundle receptacle 5 here as well. Alternatively, the bundle receptacle 5 can be designed as a type of shrink tube or form an essentially cylindrical receptacle, in which bristles 6 of the bristle bundle 7 are cast or otherwise anchored.

FIG. 10 shows the behavior of the sweeping brush 1 while in contact with an obstacle. When the bristles 6 of the bristle bundle 7 protruding from the bundle receptacle 5 come into contact with the obstacle, a force acts on the bundle receptacle 5, causing the bundle receptacle 5 to rotate around the bearing midpoint 11. For example, the position shown with dashed lines on FIG. 10 is reached in the process. In addition, the bristles 6 are potentially bent.

Figure 11:
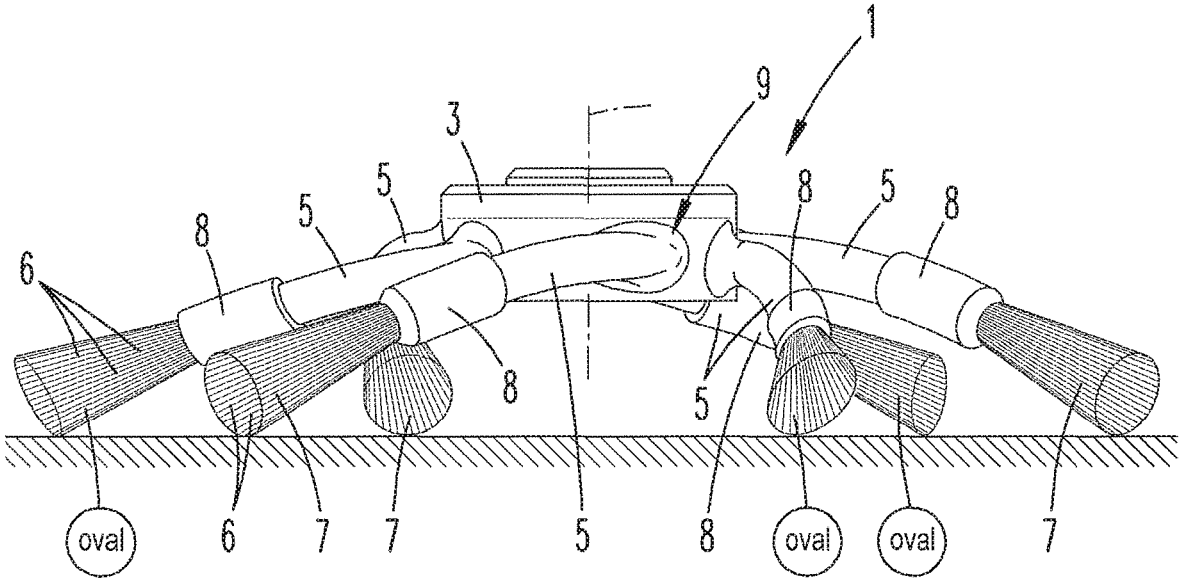
FIG. 11 is a side view of an alternative embodiment of the sweeping brush.

The bundle receptacles 5 of the sweeping brush 1 can differ from each other in a variety of parameters. For example, the bundle receptacles 5 can have varying materials, cross sectional shapes or bending radii. In addition, it is possible that the inclination of the bristle bundles 7 characterized by the angle β will differ relative to the plane of the rotational axis receptacle 3. In addition, the ratio between the length $L_1$ of the bundle receptacle 5 and the length $L_2$ of the bristle bundle 7 can vary from bundle receptacle 5 to bundle receptacle 5. In addition, the entire length $L_1+L_2$ can vary at different bundle receptacles 5. While the cross sectional shape of the bundle receptacles 5 is round in FIGS. 1-10, it is also possible for the latter to be elliptical as shown in FIG. 11 or rectangular.

REFERENCE LIST

1 Sweeping brush
2 Cleaning device
3 Rotational axis receptacle
4 Rotational axis
5 Bundle receptacle
6 Bristle
7 Bristle bundle
8 End area
9 Transition area
10 Bundle bearing
11 Bearing midpoint
12 Housing
13 Distance measuring device
14 Wheel
15 Cleaning roller
$L_1$ Length
$L_2$ Length
r Rotational direction
α Angle
β Angle

What is claimed is:

1. A sweeping brush for an automatically moving cleaning device, comprising:

a rotational axis receptacle for receiving a rotational axis of the cleaning device, and at least a first bundle receptacle and a second bundle receptacle that extends outwardly from a transition area on the rotational axis receptacle, the first bundle receptacle and the second bundle receptacle each holding a bristle bundle having a plurality of bristles, the bristles each having a longitudinal extension with respect to a radial direction of the transition area, wherein the first bundle receptacle and/or the second bundle receptacle are arched as viewed in an axial direction of the rotational axis receptacle, wherein the bundle receptacles extend at an inclination to a plane having the rotational axis receptacle as viewed in a direction oriented perpendicular to the rotational axis, and wherein the longitudinal extension of each of the bristles follows a longitudinal extension of the bundle receptacles, wherein at least one of the first bundle receptacle or the second bundle receptacle is fabricated out of an elastic material, and wherein the first bundle receptacle and second bundle receptacles exhibit material properties and/or cross-sectional shapes in the form of profile cross sections perpendicular to the longitudinal extension at a free end area of the bundle receptacles abutting the bristle bundles, that differ from each other.

2. The sweeping brush according to claim 1, wherein the end area of each bundle receptacle facing away from the rotational axis receptacle is displaced by an angle of approx. 20° to 80° relative to a radial direction that intersects the rotational axis and transitional area.

3. The sweeping brush according to claim 1, wherein the transition area has a bundle bearings on which the bristle bundles are articulated relative to a circumferential direction, so that the bristle bundles can be swiveled around a bearing midpoint of the bundle bearings during a rotation of the sweeping brush.

4. The sweeping brush according to claim 3, wherein the bristle bundles are overmolded with a material of the bundle receptacles.

5. The sweeping brush according to claim 3, wherein the length of each of the bundle receptacles is approximately one to three times as large as a length of the bristle bundle protruding from each bundle receptacle.

6. The sweeping brush according to claim 3, wherein the bundle receptacles extend at an angle of approximately 5° to 20° to the plane having the rotational axis receptacle.

7. An automatically moving cleaning device having a sweeping brush according to claim 1, wherein the bundle receptacles are arched opposite a rotational direction of the rotational axis as viewed in the axial direction of the rotational axis receptacle.

* * * * *